US012779274B2

(12) United States Patent
Trower et al.

(10) Patent No.: US 12,779,274 B2
(45) Date of Patent: Nov. 3, 2026

(54) APPARATUS AND METHOD FOR ASSISTING WITH OPERATION OF EXERCISE EQUIPMENT

(71) Applicant: TROWFORCE, LLC, Spring, TX (US)

(72) Inventors: John Trower, Spring, TX (US); Kevin Anderson, Spring, TX (US)

(73) Assignee: TROWFORCE, LLC, Spring, TX (US)

( * ) Notice: Subject to any disclaimer, the term of this patent is extended or adjusted under 35 U.S.C. 154(b) by 0 days.

(21) Appl. No.: 19/421,109

(22) Filed: Dec. 16, 2025

(65) Prior Publication Data

US 2026/0183602 A1 Jul. 2, 2026

Related U.S. Application Data

(60) Provisional application No. 63/740,459, filed on Dec. 31, 2024.

(51) Int. Cl.
*A63B 21/078* (2006.01)
*A63B 21/00* (2006.01)
*A63B 21/28* (2006.01)

(52) U.S. Cl.
CPC .... *A63B 21/0783* (2015.10); *A63B 21/00181* (2013.01); *A63B 21/154* (2013.01); *A63B 21/285* (2013.01)

(58) Field of Classification Search
CPC ..... A63B 21/00181; A63B 21/0783; A63B 21/154; A63B 21/285
See application file for complete search history.

(56) References Cited

U.S. PATENT DOCUMENTS

| | | | | |
|---|---|---|---|---|
| 4,564,194 | A * | 1/1986 | Dawson | A63B 21/0626 482/102 |
| 5,273,506 | A * | 12/1993 | Dawson, Jr. | A63B 21/0626 482/104 |
| 9,327,160 | B2 * | 5/2016 | Tauriainen | A63B 21/0783 |
| 10,926,125 | B1 * | 2/2021 | Candler | A63B 21/08 |
| 12,194,331 | B2 * | 1/2025 | O'Connor | A63B 21/0783 |
| 12,274,906 | B2 * | 4/2025 | Henseler | A63B 17/02 |
| 12,458,833 | B2 * | 11/2025 | Abbott | A63B 21/0722 |
| 2005/0277524 | A1 * | 12/2005 | Bae | A63B 21/4029 482/93 |
| 2006/0148624 | A1 * | 7/2006 | Bae | A63B 21/078 482/93 |
| 2024/0139576 | A1 * | 5/2024 | Henseler | A63B 21/078 |
| 2024/0366991 | A1 * | 11/2024 | Henseler | A63B 21/0632 |

* cited by examiner

*Primary Examiner* — Joshua Lee
(74) *Attorney, Agent, or Firm* — Greer, Burns & Crain, Ltd

(57) ABSTRACT

An apparatus for enabling a spotter to assist a lifter in a weight lifting exercise comprises a clamp for removably attaching to and enclosing a bar for free weights in an interior therein, the clamp securely retaining the bar along a length of the clamp, the bar being lifted by the lifter during the weight lifting exercise. The clamp is securely and removably attachable to a cable at an attachment end of the cable, the cable being disposed about a wheel of a pulley that is anchored to a stable point. A free end of the cable is manipulable by the spotter to selectively operate the pulley to assist with raising and lowering the bar.

12 Claims, 17 Drawing Sheets

APPARATUS AND METHOD FOR ASSISTING WITH OPERATION OF EXERCISE EQUIPMENT

RELATED PATENT APPLICATION

This patent application U.S. Utility application which claims priority to and the benefit of U.S. Provisional Ser. No. 63/740,459, filed on Dec. 31, 2024. The entire content of the foregoing patent application, including all text and drawings, is herein incorporated by reference for all purposes.

FIELD

The present disclosure relates generally to the field of fitness equipment. Particular embodiments of the invention relate more particularly to methods and systems for assisting with operation of exercise equipment, namely weightlifting.

BACKGROUND

For weightlifting exercises where one party (a lifter) is lifting free weights, such as bench presses or squats, it is useful to have a supporting second party (a spotter) to assist by grabbing the bar to help lift the bar, e.g., to stabilize the bar or help return the weights to a rack when needed or requested. This allows the lifter to continue their reps up to and past the fatigue point where otherwise the lifter would need to rack the weights, including so-called burnout reps. A spotter is also useful to reduce the risk of the lifter unintentionally dropping the weights. Using a spotter allows the lifter to increase a number of maximum reps, increase rack weight, or a combination.

However, during spotting the bar may be at a position relative to the spotter that forces the spotter to grab and lift the bar at an awkward angle. Combined with the typically significant amount of weight to be lifted, especially as a result of burnout reps, this can cause undesirable strain and possibly injury for the spotter. As a result, conventional spotting techniques may not be optimal to help with weightlifting exercises, such as during burnout reps.

SUMMARY

According to one aspect of the disclosed embodiments, an apparatus for enabling a spotter to assist a lifter in a weightlifting exercise comprises a clamp for removably attaching to and enclosing a bar for free weights in an interior therein, the clamp securely retaining the bar along a length of the clamp, the bar being lifted by the lifter during the weight-lifting exercise. The clamp is securely and removably attachable to a cable at an attachment end of the cable, the cable being disposed about a wheel of a pulley that is anchored to a stable point. A free end of the cable is manipulable by the spotter to selectively operate the pulley to assist with raising and lowering the bar.

In alternative embodiments, provided is an apparatus for enabling a spotter to assist a lifter in a weight lifting exercise, the apparatus comprising:

- a clamp for removably attaching to and enclosing a bar for free weights in an interior therein, the clamp securely retaining the bar along a length of the clamp, the bar being lifted by the lifter during the weight lifting exercise;
- the clamp being securely and removably attachable to a cable at an attachment end of the cable, the cable being disposed about a wheel of a pulley that is anchored to a stable point;

- wherein a free end of the cable is manipulable by the spotter to selectively operate the pulley to assist with raising and lowering the bar.

In alternative embodiments, provided is an apparatus as provided herein:

- the stable point comprises a portion of a frame of a weight rack;
- the clamp comprises: first and second semi-cylindrical sections removably coupled to one another to together define the interior of the clamp; and/or, at least one clamp lock removably coupled to the first and second sections to secure a connection;
- the first and second sections are further coupled to one another via one or more hinges;
- the apparatus further comprises: an insert disposed within the interior of the clamp, the insert comprising first and second sections for being removably disposed about the bar to accommodate the bar in an interior of the insert; wherein the insert accommodates bars of varying diameters;
- the apparatus further comprises: an additional clamp for anchoring the pulley to the stable point, the additional clamp being securely and removably attachable to the pulley and removably attachable to the stable point;
- the clamp is a double-length claim, and the additional clamp is a single-length clamp;
- the apparatus further comprises: a cylindrical wrap of a soft material disposed around the outer surface of the clamp;
- the free end of the cable includes a manipulable member for to selectively operate the pulley, the manipulable member comprising one or more of loops, handles, handlebars, or grips;
- the cable comprises one or more of a cable, cord, line, or rope;
- the free end of the cable is disposed behind a bench for the lifter and/or in front of the weight rack; and/or
- the free end of the cable is disposed in front of a bench for the lifter and/or in front of the weight rack.

Various examples are disclosed herein. Other features and advantages of the invention will be apparent from the following specification taken in conjunction with the following drawings.

The details of one or more exemplary embodiments of the invention are set forth in the accompanying drawings and the description below. Other features, objects, and advantages of the invention will be apparent from the description and drawings, and from the claims.

All publications, patents, patent applications cited herein are hereby expressly incorporated by reference in their entireties for all purposes.

DESCRIPTION OF THE DRAWINGS

The drawings set forth herein are illustrative of exemplary embodiments provided herein and are not meant to limit the scope of the invention as encompassed by the claims.

The present disclosure will become more fully understood from the detailed description and the accompanying drawings, wherein.

In the drawings, reference numbers may be reused to identify similar and/or identical elements.

DETAILED DESCRIPTION

Figure 1:
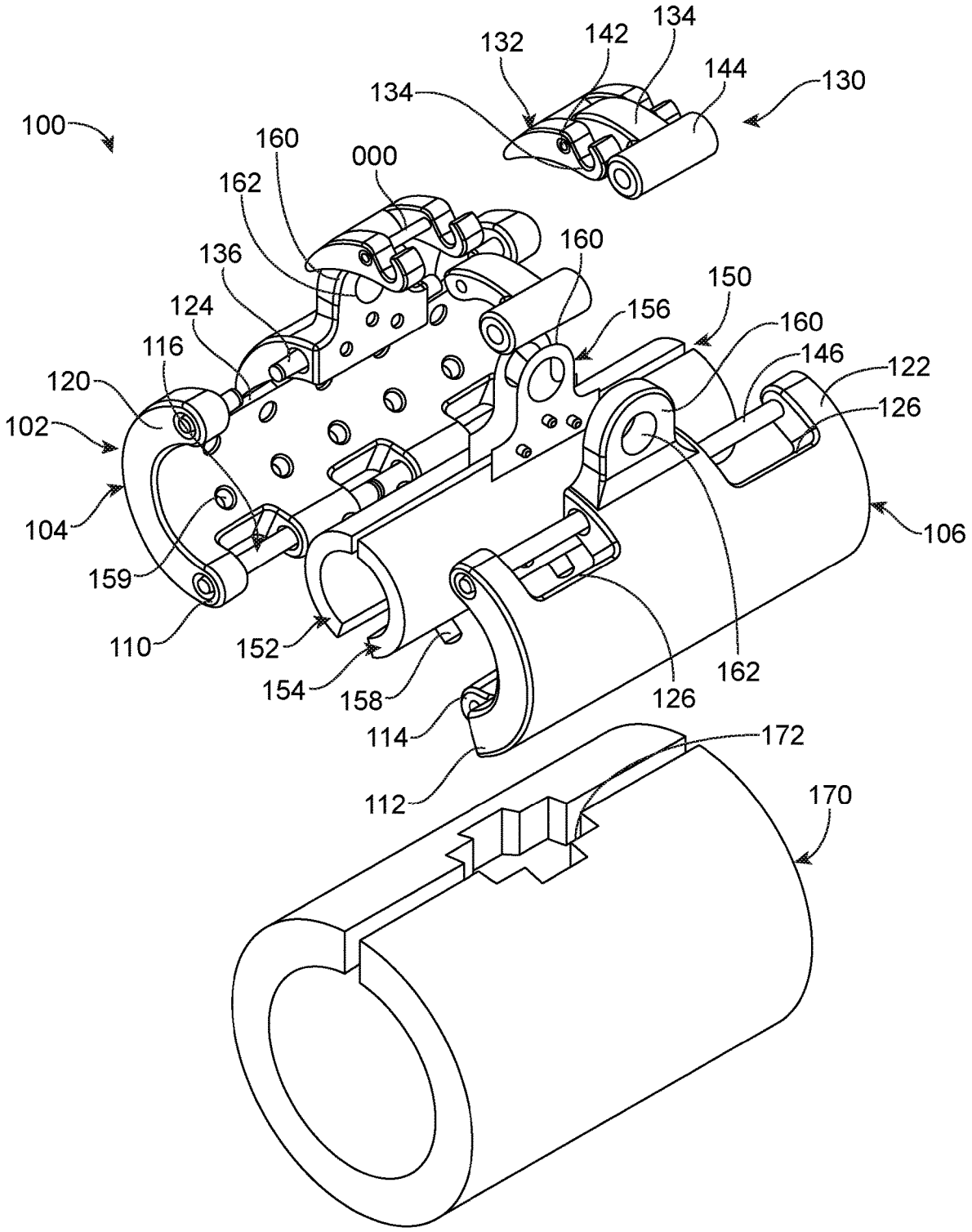
FIG. 1 is an exploded perspective view of an example double-length clamp for an exercise assistance system according to an example embodiment.

Embodiments of the invention provide, among other things, an exercise assistance apparatus that may be used to supplement and/or replace the traditional spotter in a workout facility. An example apparatus can enhance the workout experience for both a first party (e.g., a lifter) and a second party (e.g., a spotter) for partner workouts, enhancing or maximizing overall burnout and fundamental basic weight-lifting. An example system is easy to use, and can provide an innovative workout for both beginner and more experienced trainers.

An example apparatus includes a clamp for removably attaching to and securely retaining therein a weight bar (bar) for free weights (e.g., barbell or dumbbell) that is to be lifted by a lifter. The lifter may be, for instance, lying on a bench disposed near or under a frame of a weight rack. Example clamps can be configured to accommodate various bar diameters, providing a more versatile design. Example clamps can include one or multiple locking mechanisms for securely holding the bar. An outside layer, e.g., of foam or similar material, may be disposed about an example clamp for providing additional comfort for bench pressing, squatting, etc.

The clamp is securely and removably attachable to an attachment end of a cable, cord, line, rope, etc. (collectively, cable) that is disposed about a pulley, such as but not limited to a fixed pulley. An example pulley is anchored to a stable point, e.g., directly or indirectly, such as via an attachment, one example of which being another clamp attached to a frame of a weight rack or elsewhere. An opposed free end or ends of the cable (end) is manipulable (e.g.,) by a spotter to assist with raising or lowering the bar by selectively pulling or releasing the cord to increase or decrease tension. The opposed end of the cord may, but need not, include or be coupled to one or more manipulating members such as handles, handlebars, loops, grips, rope ends, bars, or other suitable devices for allowing the spotter to manipulate the pulley by pulling the cord to selectively assist in raising or lowering the bar. Manipulating the cord, either directly or via the manipulating members, also provide an exercise opportunity for the spotter.

The clamp, additional clamp (if used), pulley, cable, and manipulating members (if used) can together provide a system for exercise assistance. Various pulleys, manipulating members, and/or anchors may be used with example clamps, non-limiting examples of which are provided herein for illustration.

Because example systems allow the spotter to operate the free end of the cable for the pulley (e.g., pull or release with varying levels of tension to assist with raising or lowering the bar) from a direction in front of the lifter (e.g., in front of the bench and/or the weight rack), it is not necessary for the spotter to be positioned behind or around the lifter to grab and lift or lower the bar. The spotter can thus operate the pulley with less strain than can occur during a conventional spotting operation. However, in other assistance operations, the free end of the cable for the pulley, and thus the spotter, may be disposed behind the lifter (e.g., behind the bench and/or the weight rack). Spotting using example methods herein can be made easier and more ergonomic, e.g., providing an improved and/or more consistent form. The dual process used in example operations provides exercise for both the lifter and the spotter. Spotters and lifters of various capabilities (e.g., ages, sizes, strength, etc.) can better help one another for weight training while more easily observing proper form.

Example devices can be implemented in any suitable environment, including but not limited to home gyms, commercial gyms, or other workout facilities.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize additional features and broader aspects of the invention.

Figure 2:
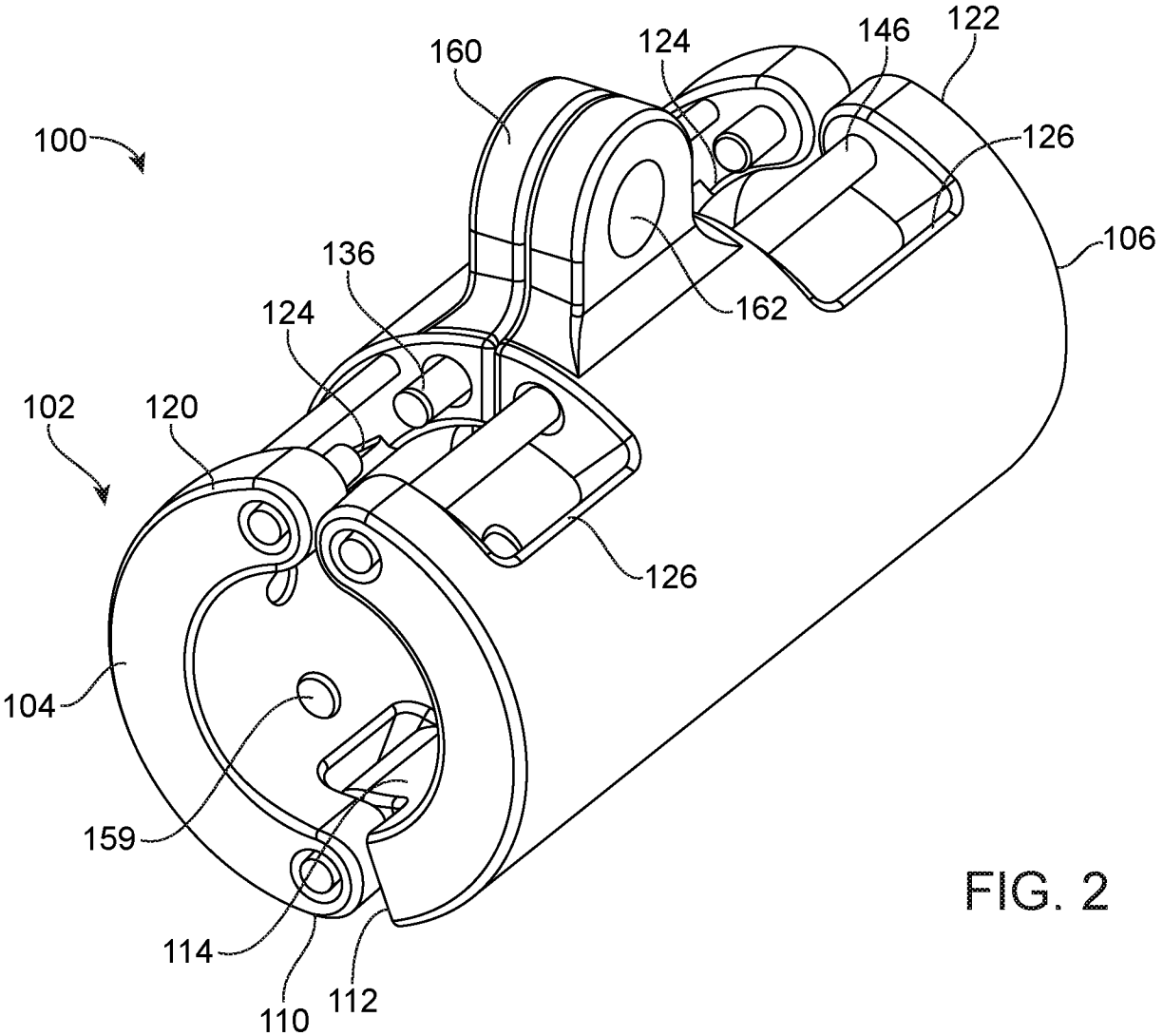
FIG. 2 is a perspective view of the example double length clamp.
Figure 4:
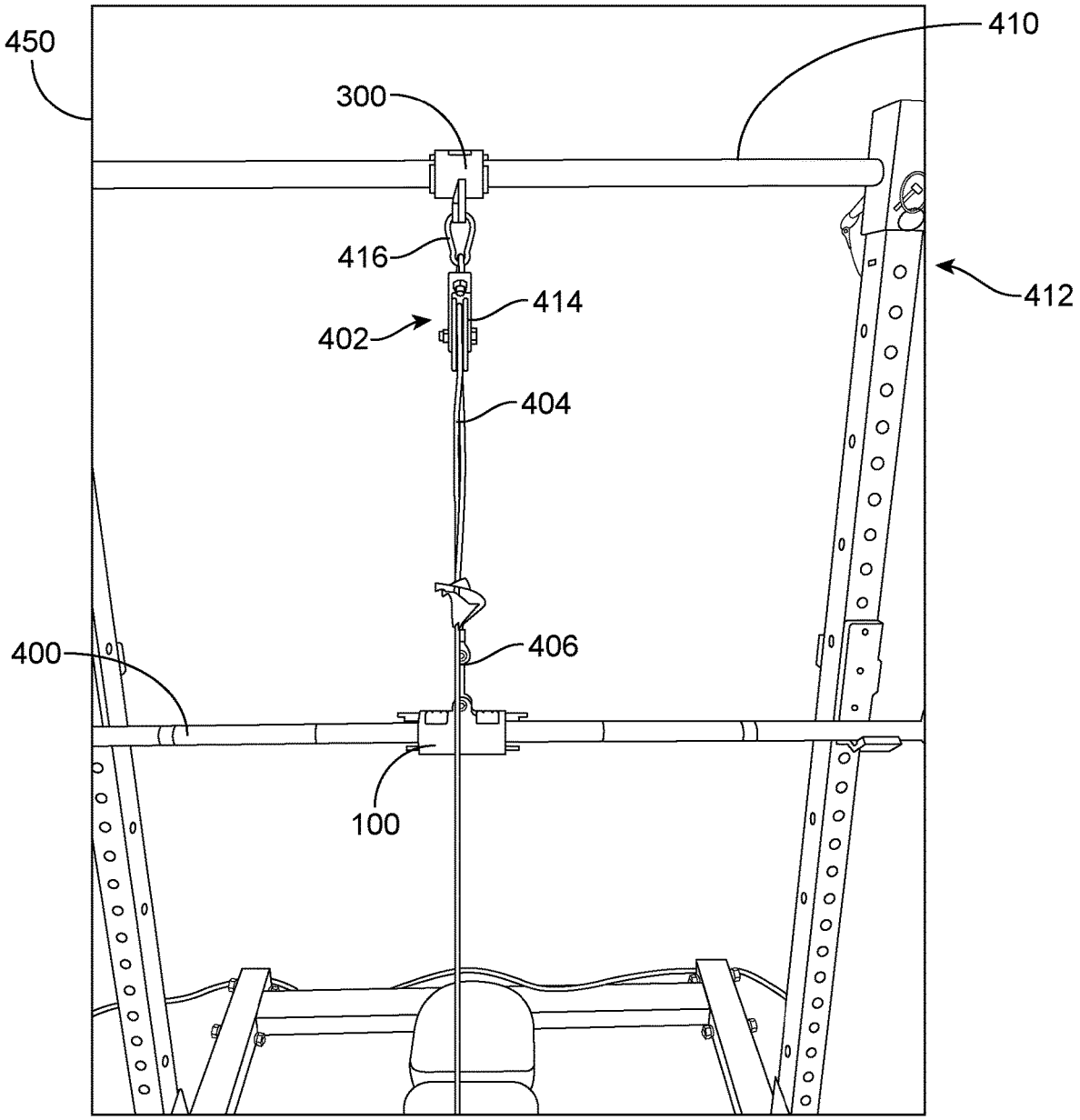
FIG. 4 shows an example exercise assistance system installed on a weight rack and a bar in an example operation.
Figure 5:
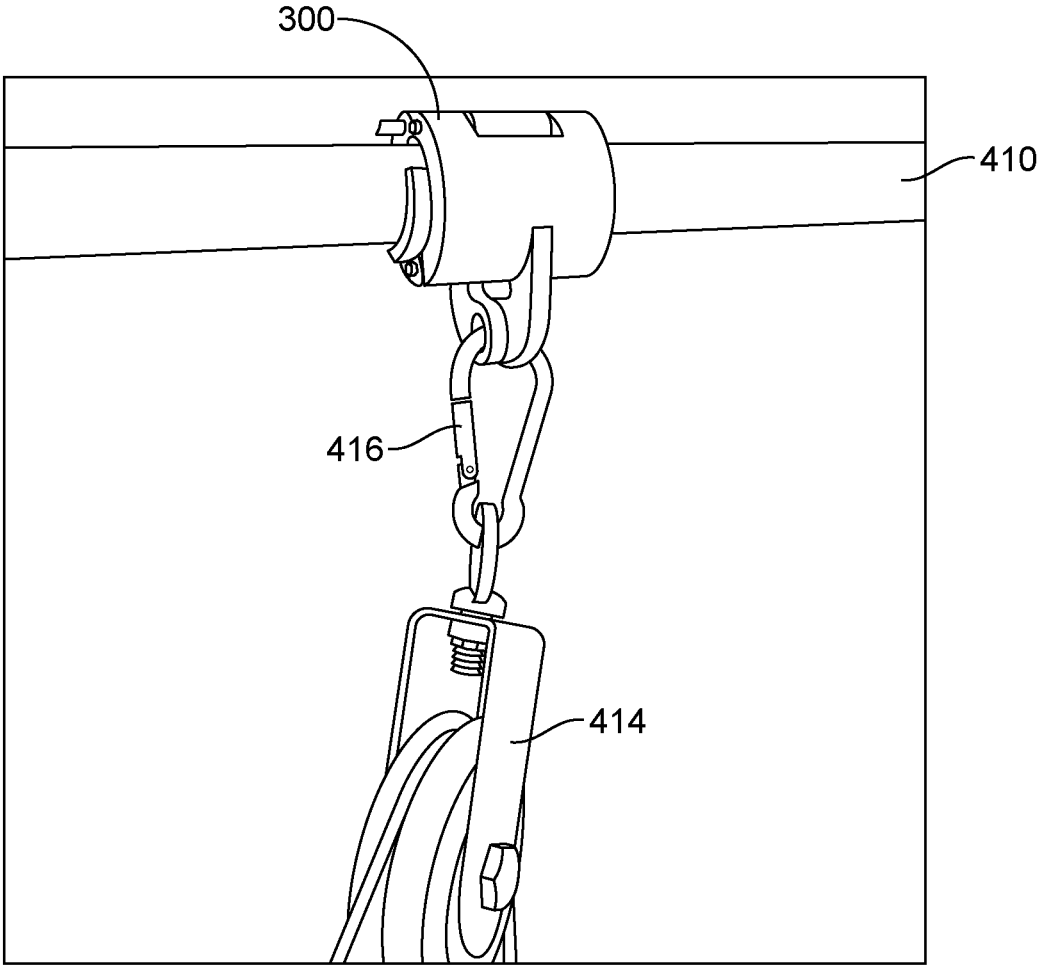
FIG. 5 shows the example single length clamp and pulley of the exercise assistance system connected to a frame of a weight rack.
Figure 6:
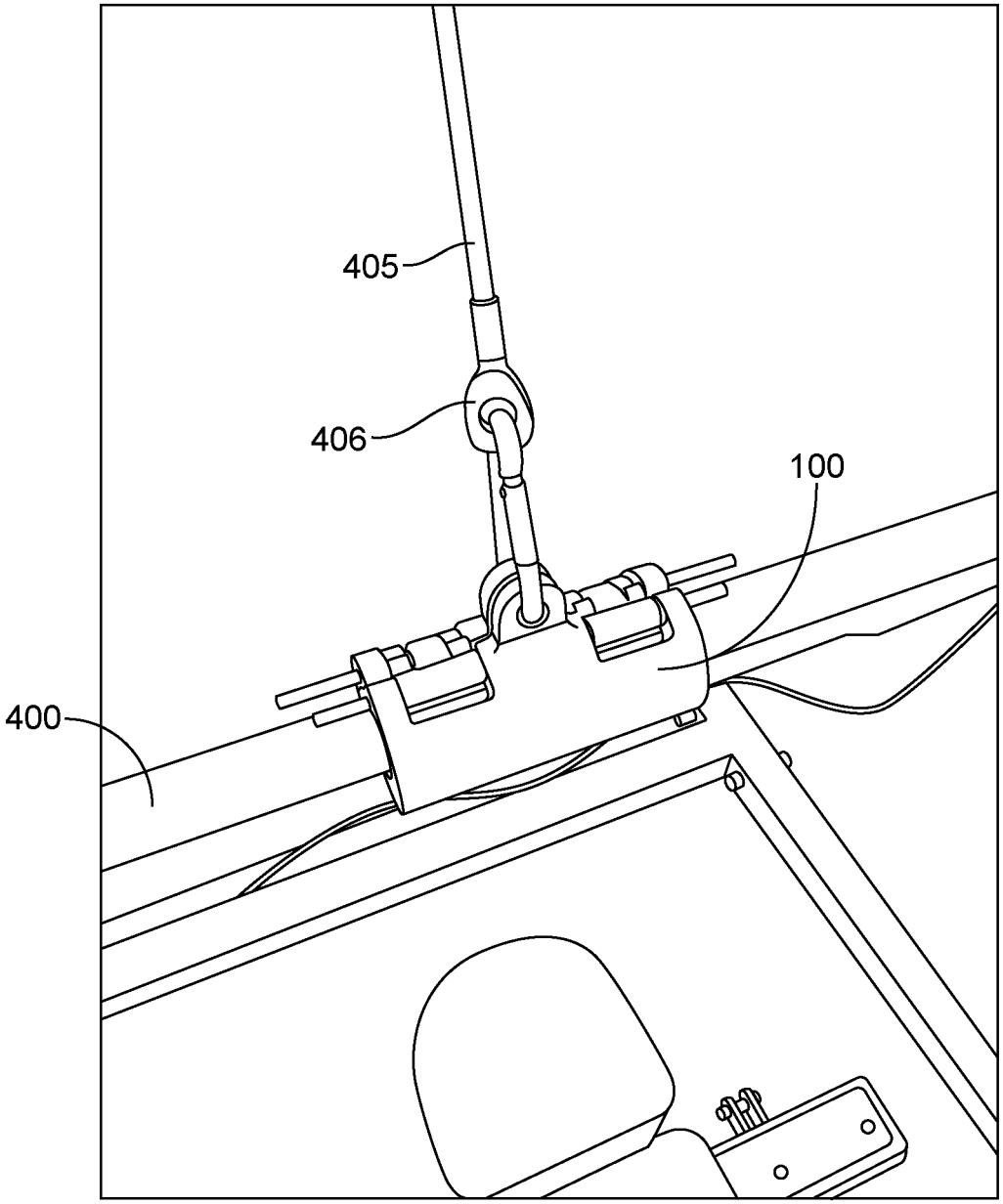
FIGS. 6 and 7 show the example double length clamp and pulley of the exercise assistance system connected to a bar.
Figure 7:
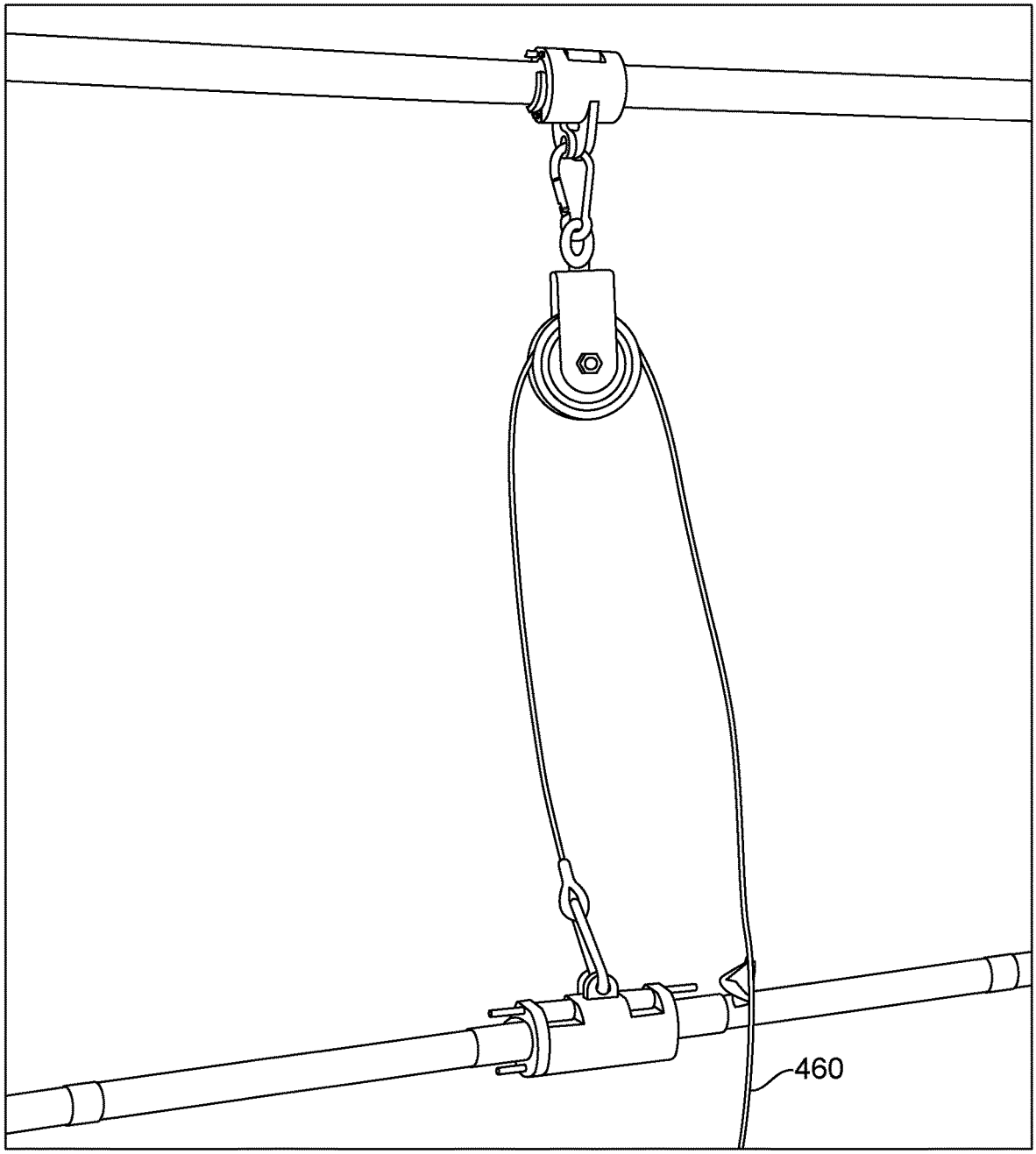

FIGS. 1-2 show an example clamp 100 for securely accommodating and retaining therein a weight bar (bar) such as bar 400 shown in FIG. 4. The clamp 100 includes a generally cylindrical frame 102 embodied in first (e.g., left) 104 and second (e.g., right) 106 sections (e.g., generally semi-cylindrical sections, or halves) that can be placed about the bar 400, either directly or with one or more intervening components, and then assembled to one another to provide an interior that generally encloses the bar 400 therein to accommodate the bar along the length of the clamp. FIG. 1 shows the clamp 100 in an open position, and FIG. 2 shows the clamp in a closed position. The clamp 100 may be made of a suitably strong material, such as but not limited to steel or other strong metal.

Lower ends 110, 112 (as shown in the orientation of FIG. 1) of the left and right sections 104, 106, respectively, may be coupled (e.g., pivotably, rotatably, or hingedly connected) to one another, e.g., via one or more hinges 114, which rotate about one or more pins 116 disposed therethrough. The left and right sections 104, 106 may be, but need not be, partially preassembled via the hinges 114 before being positioned about the bar 400.

Upper ends 120, 122 of the left and right sections 104, 106, respectively, each include a pair of openings 124, 126 for respectively receiving a pair of clamp locks 130. Each example clamp lock 130 includes a first section 132 having a pair of upwardly facing hooks or seats 134 for receiving pins 136 inserted through receiving holes adjacent the opening 124 in the left section 104. A second section 140 of the clamp lock 130 is (e.g., rotatingly) coupled to the first section 132 via a pin 142, and includes a clamp loop 144 that is disposed within the opening 126 in the right section 106 and secured thereto via a pin 146 extending through receiving holes adjacent the opening 126.

A generally cylindrical insert 150 may be provided and sized to selectively accommodate and more securely retain bars of various configurations or sizes (e.g., diameters). The example insert 150 includes left and right generally semi-cylindrical sections or halves 152, 154 that can be selectively and removably disposed around the bar 400 during assembly and provide an interior for accommodating the bar along the length of the insert. The interior can accommodate various diameters of bars, e.g., as the paired sections 152, 154 need not fully surround bars having larger diameters. An example material for the insert 150 is rubber or silicone. The clamp 100 can be fitted around the insert 150 to generally enclose the insert within the interior of the clamp, and in this way the bar 400 is also disposed (indirectly) within the interior of the clamp. Spring snaps 156, e.g., made of soft rubber, may be connected to the sections 152, 154, e.g., via one or more fasteners 156. Inserts 158, e.g., of rubber or silicone, may be provided on an exterior surface of the insert 150 and received by openings 159 in the left and right sections 104, 106 to secure the insert 150.

The left and right sections 104, 106 of the clamp 100 and optionally, the left and right sections 152, 154 of the insert 150, can include a bracket 160 having an opening 162 for removably attaching, e.g., receiving and connecting, to a portion of a pulley, e.g., pulley 402 with cable 404, e.g., via an attachment member 406, such as one or more hooks, rings, chains, buckles, latches, loops, links, etc. so that the clamp 100 can be removably attached to the cable 404 and/or to the pulley 402. The attachment member 406, for instance, can attach to an attachment end 405 of the cable 404.

To assemble the clamp 100, the insert 150 is positioned around the bar to enclose the bar. Pins 136 are inserted into the openings 124, 126, and pins 116 are inserted into hinges 114. The first and second sections 132, 140 of each of the two clamp locks 130 are assembled via pins 142. The first section 132 of each clamp lock 130 is fitted into respective openings 124. The clamp loops 144 for each clamp lock are then rotated or pivoted into the openings 126 and secured using pin 146 to securely connect the left and right section 104, 106.

A cylindrical wrap 170, e.g. made of foam or similar soft material, may be fitted around an outer surface of the assembled clamp 100 for providing additional comfort for bench pressing, squatting, etc. The brackets 160 can extend through an opening 172 in the wrap 170.

Figure 3:
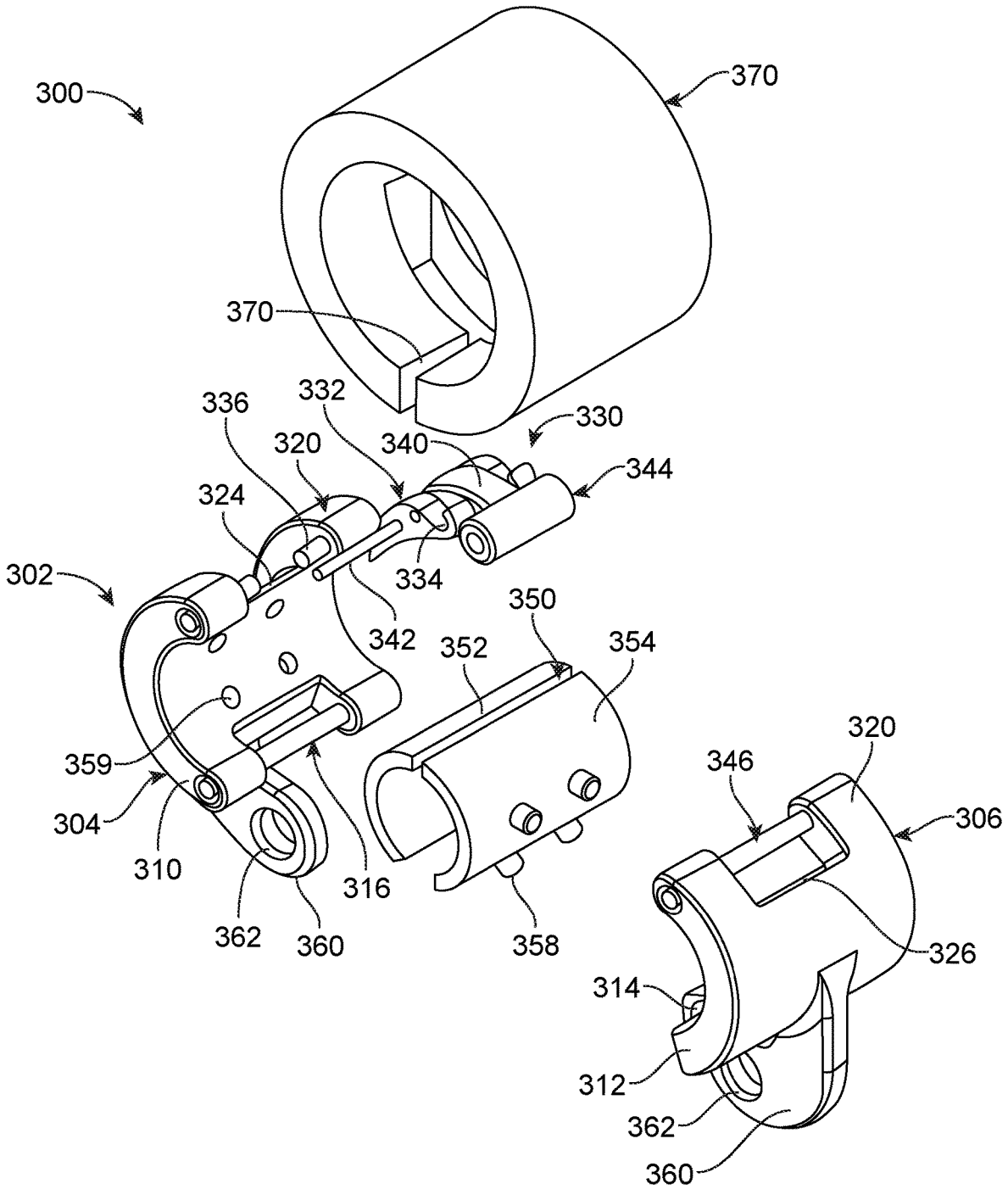
FIG. 3 is an exploded view of an example single length clamp.

FIG. 3 shows another example clamp 300 that is configured generally similarly to clamp 100. However, clamp 300 has a smaller length than clamp 100 (as a non-limiting example, about one-half of the length of clamp 100) and includes a single clamp lock 330. For convenience of explanation, clamp 100 can be referred to as a double-length clamp, and clamp 300 can be referred to as a single-length clamp.

The clamp 300 includes a generally cylindrical frame 302 embodied in left 304 and right 306 sections (e.g., generally semi-cylindrical sections, or halves) that can be placed about a cylindrical member, such as but not limited to a bar forming a portion of a frame 410 of a weight rack 412, and then assembled to one another to provide an interior that generally encloses the cylindrical member therein to accommodate the cylindrical member along the length of the clamp. As with clamp 100, the clamp 300 may be made of a suitably strong material, such as but not limited to steel or other strong metal. Lower ends 310, 312 (as shown in the orientation of FIG. 1) of the left and right sections 304, 306, respectively, may be coupled (e.g., pivotably or hingedly connected) to one another, e.g., via one or more (as shown, one) hinges 314, which rotate about one or more (as shown, one) pins 316 disposed therethrough.

Upper ends 320 of the left and right sections 304, 306, respectively, each include an opening 324, 326 for receiving the clamp lock 330, which can be configured similarly to claim lock 130, including a first section 332 having a pair of upwardly facing hooks or seats 334 for receiving pins 336 inserted through receiving holes adjacent the opening 324 in the left section 304. A second section 340 of the clamp lock 330 is (e.g., rotatingly) coupled to the first section 332 via a pin 342, and includes a clamp loop 344 that is disposed within the opening 326 in the right section 306 and secured thereto via a pin 346 extending through receiving holes adjacent the opening 326.

A smaller length generally cylindrical insert 350 may be provided and sized to selectively accommodate and more securely retain cylindrical members (e.g., bars) of various configurations or sizes (e.g., diameters). The example insert 350 includes left and right generally semi-cylindrical sections or halves 352, 354 that can be selectively and removably placed around the cylindrical member, e.g., frame 410, during assembly and provide an interior for accommodating the cylindrical member along the length of the insert. The interior can accommodate various diameters of cylindrical members, e.g., as the paired sections 352, 354 need not fully surround cylindrical members having larger diameters. The clamp 300 can be fitted around the insert 350 to generally enclose the insert 350 within the interior of the clamp 300, and in this way the frame 410 (for instance) can be also disposed (indirectly) within the interior of the clamp. An example material for the insert 350 is rubber or silicone. Inserts 358, e.g., of rubber or silicone, may be provided on an exterior surface of the insert 350 and received by openings 359 in the left and right sections 304, 306 to secure the insert.

The left and right sections 304, 306 of the clamp 300 can include a bracket 360 having an opening 362 for removably attaching, e.g., receiving and connecting to, a portion of a pulley, e.g., attachment member 416 of pulley 402 so the clamp can be removably attached to the pulley. The clamp 300 may be assembled similarly to clamp 100, except that only one clamp lock 330 is provided. A reduced length cylindrical wrap 370, e.g. made of foam or similar soft material, may be fitted around an outer surface of the assembled clamp 300 for providing additional comfort for bench pressing, squatting, etc. The brackets 360 can extend through an opening 372 in the wrap 370.

Figure 8:
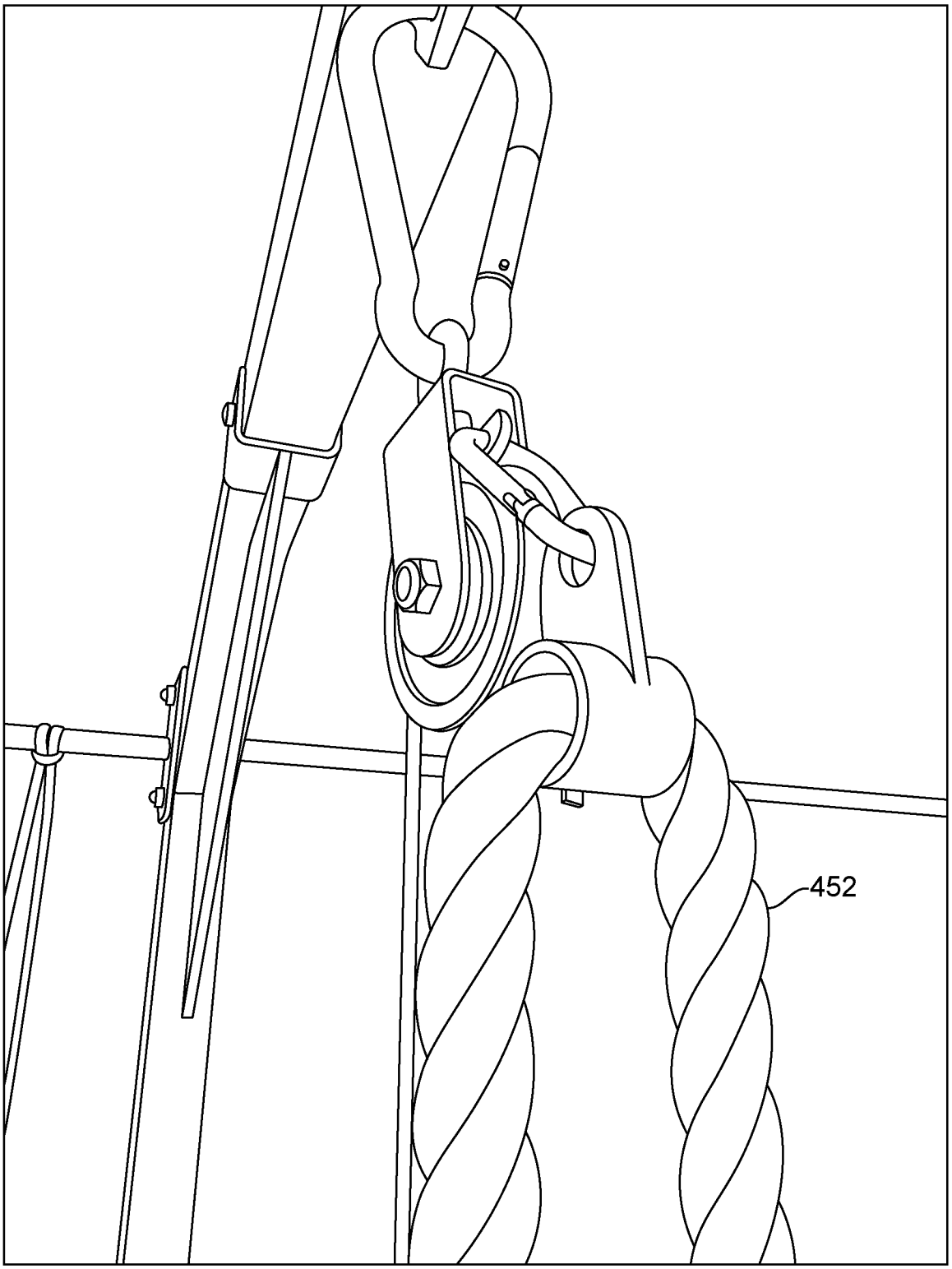
FIG. 8 shows another connection for a pulley including a rope.

FIGS. 4-7 show an example exercise assistance system 450, including a double length clamp 100 receiving and securing a weight bar (bar) 400, a pulley 402, e.g., a fixed pulley, and a cable, cord, rope, line, etc. (generally, "cable"), e.g., cable 404 having an attachment end 405 (see also FIG. 6) coupled (e.g., connected directly or indirectly) to the double length clamp 100 via links 406. The pulley 402 is anchored to a stable location, here a frame 410 of a weight rack 412 (see also FIG. 5), via a single length clamp 300 that is connected to a wheel 414 of the pulley via an attachment member such as but not limited to links 416. The single length clamp 300 receives and secures the frame 410. The pulley 402 may be any suitable pulley, and the present invention is not limited to a particular pulley, cable, or attachment. FIG. 8 shows another example cable embodied in a rope 452.

A free end 460 of the cable 404 (see FIG. 7) may terminate in any suitable end or structure. In some example exercise assistance systems 450 the free end 460 of the cable terminates in one or more to one or more manipulating members such as individual loops or handles 1200 (FIG. 12) and 1600 (FIG. 16), handlebars 1300 (FIGS. 13-14), grips 1500 (FIG. 15), pairs of loops or handles 1700 (FIG. 17), or other suitable devices. In operation, the spotter manipulate the pulley by pulling the cable 404 via the free end 460 and/or manipulating members to selectively assist in raising or lowering the bar 400.

Example exercise assistance systems may be provided in various configurations, including any suitable combination of clamps 100, 300, pulleys 402, cables 404, 452, anchors (e.g., frame 410), free ends 460, and/or manipulating members 1200, 1300, 1500, 1600, 1700. The relative positions of the free ends 460 and/or manipulating members 1200, 1300, 1500, 1600, 1700 relative to the lifter can also vary, e.g., by the arrangement of the cables 404, 452, pulleys 402 and/or anchors, and thus the spotter and the lifter can be in various relative positions for providing spotting to a lifter, or for performing any of various dual exercises. Listed below are some examples of dual workouts that can be done using example exercise assistance systems, where Persons 1 and 2 may be, for instance, a lifter and a spotter, respectively:

Person 1: Bench press.

Person 2: Shoulder, Forearms, Back.

Person 1: Inclines.

Person 2: Curls, Skull Crushers, Neck.

Person 1: Squats.

Person 2 Arms.

Figure 9:
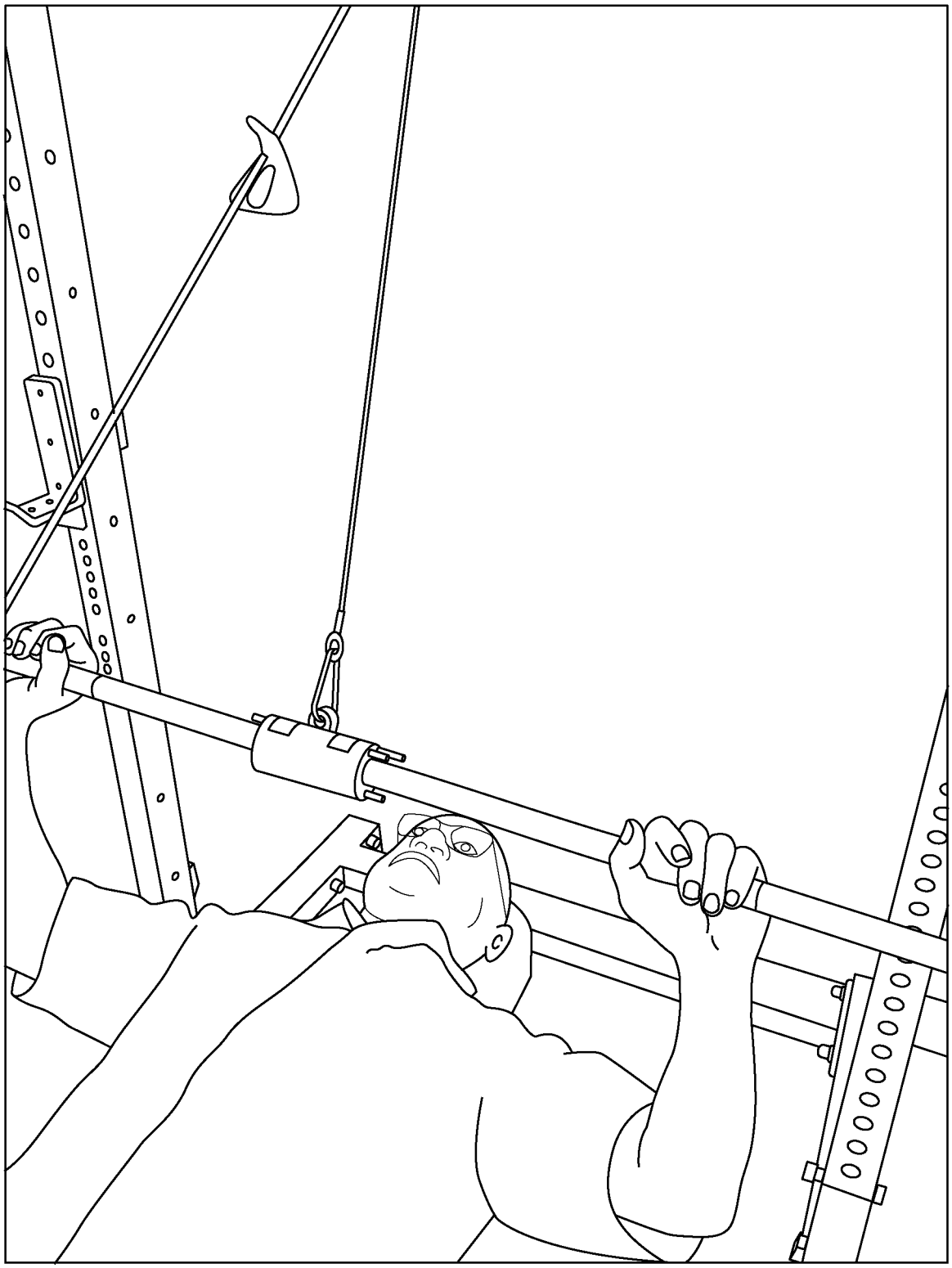
FIGS. 9-11 show an example operation of the exercise assistance system, where the bar is in a lowered position (FIGS. 9-10) and in a raised position (FIG. 11).
Figure 10:
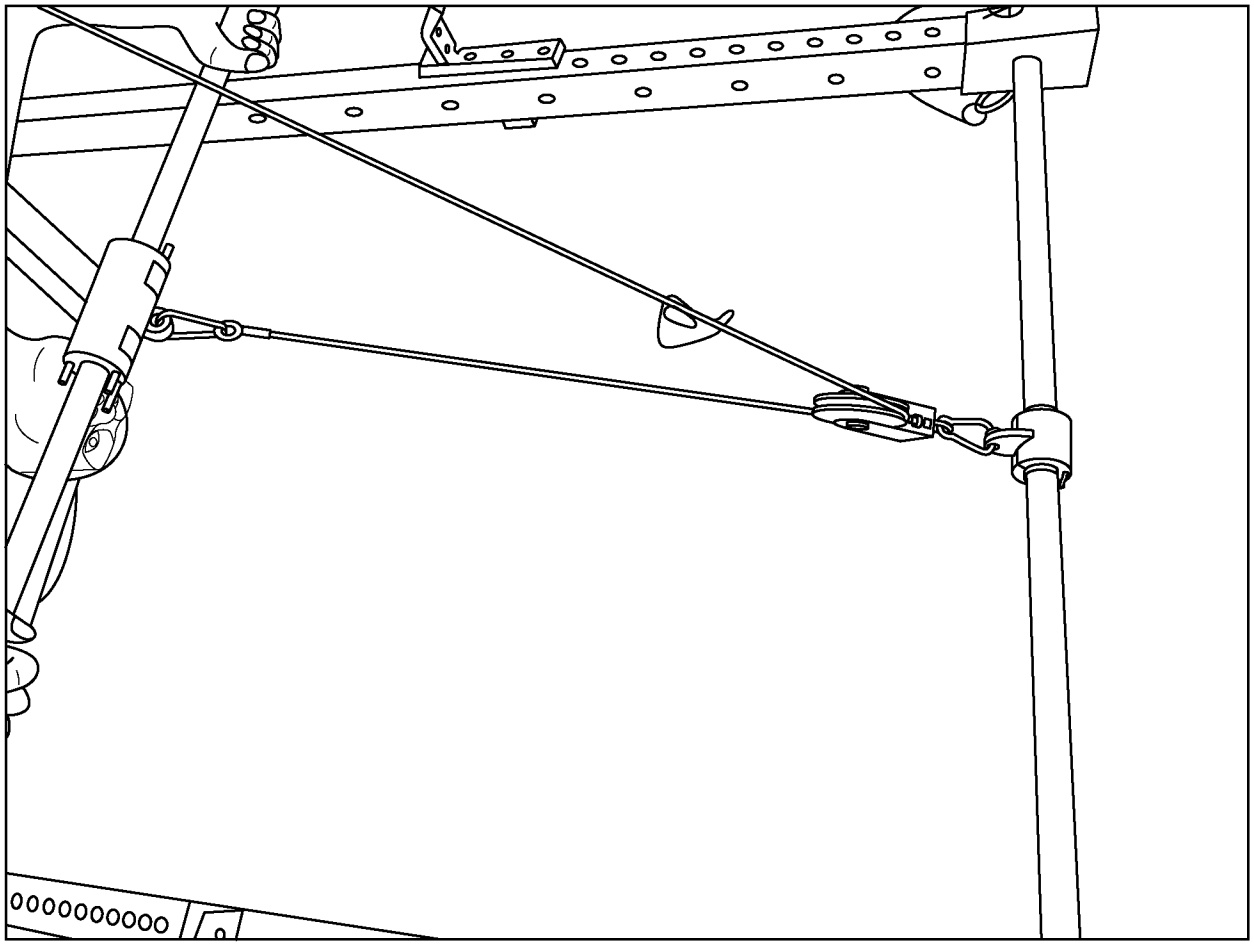
Figure 11:
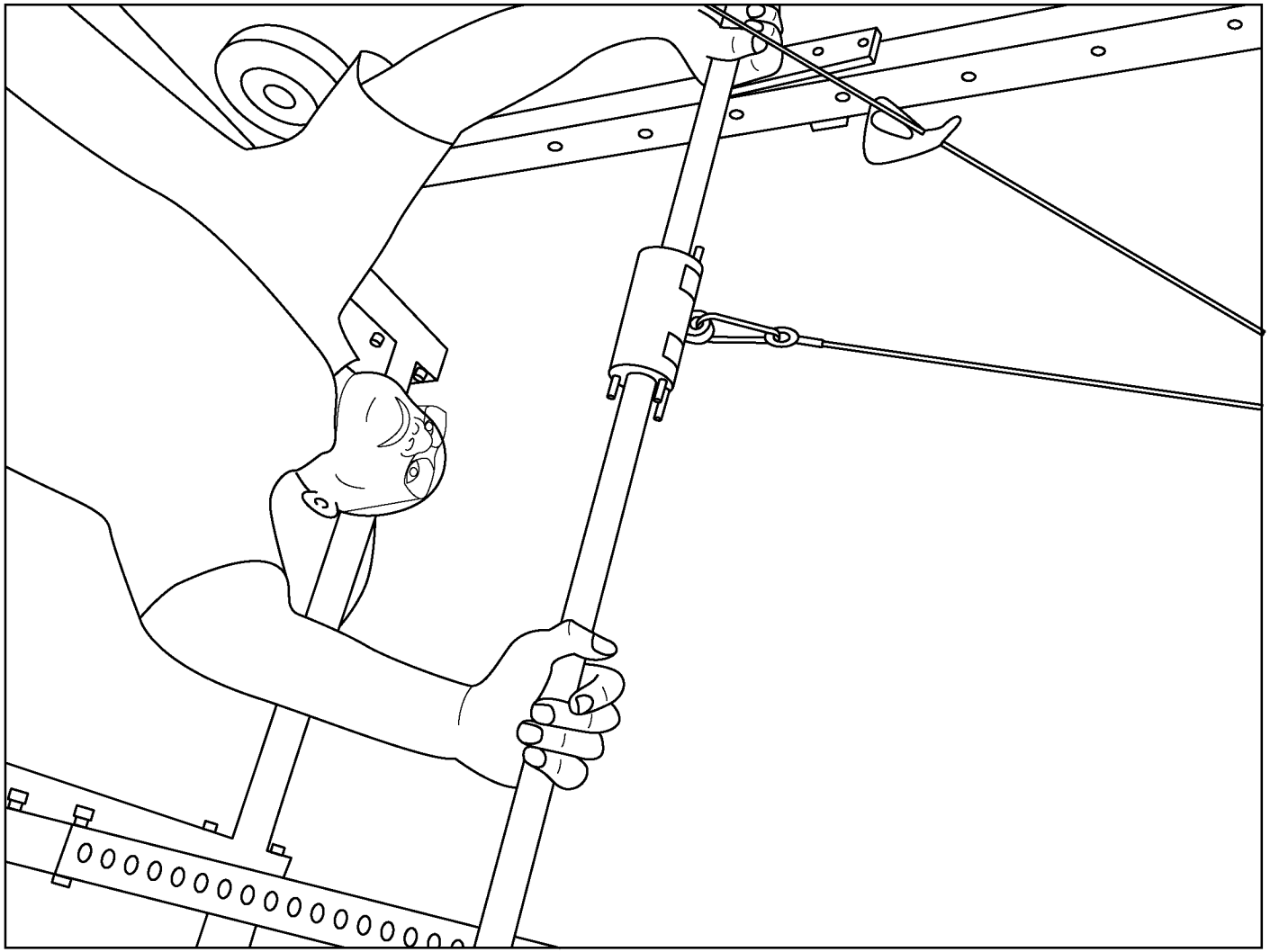

For further illustration, FIGS. 9-11 show an example operation of the exercise assistance system where a lifter is being assisted in lifting by a spotter manipulating (e.g., selectively pulling or releasing to increase or reduce tension) the free end of a cable in front of the lifter, where the bar is in a lowered position (FIGS. 9-10) and in a raised position (FIG. 11). The manipulation of the may be of any suitable form, using any suitable manipulation member (or none, if only a free end of the cable is held).

Figure 12:
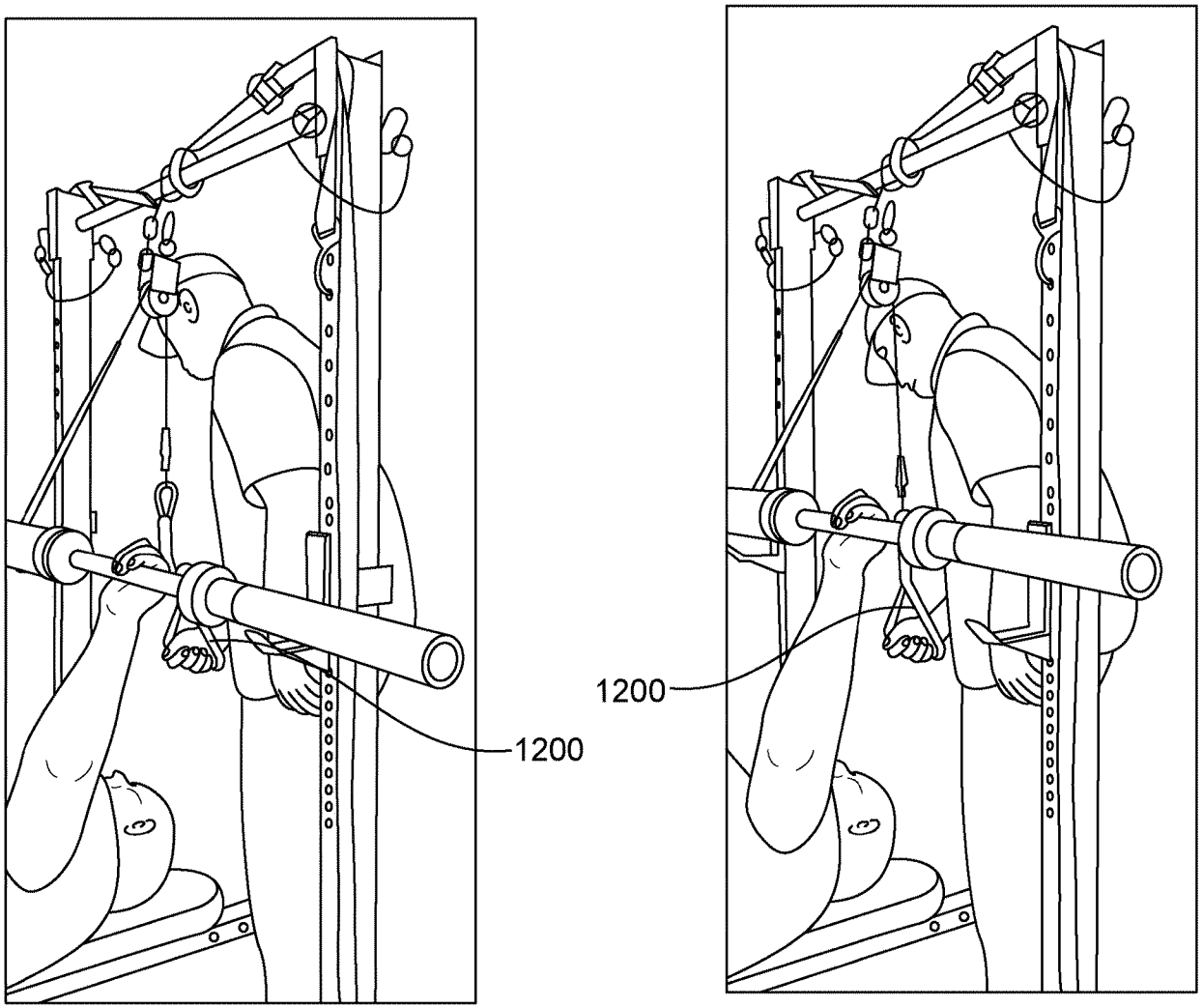
FIG. 12 shows an example operation of the exercise assistance system where the spotter engages a loop from a standing position to operate the pulley to lower (left) and raise (right) the bar.
Figure 13:
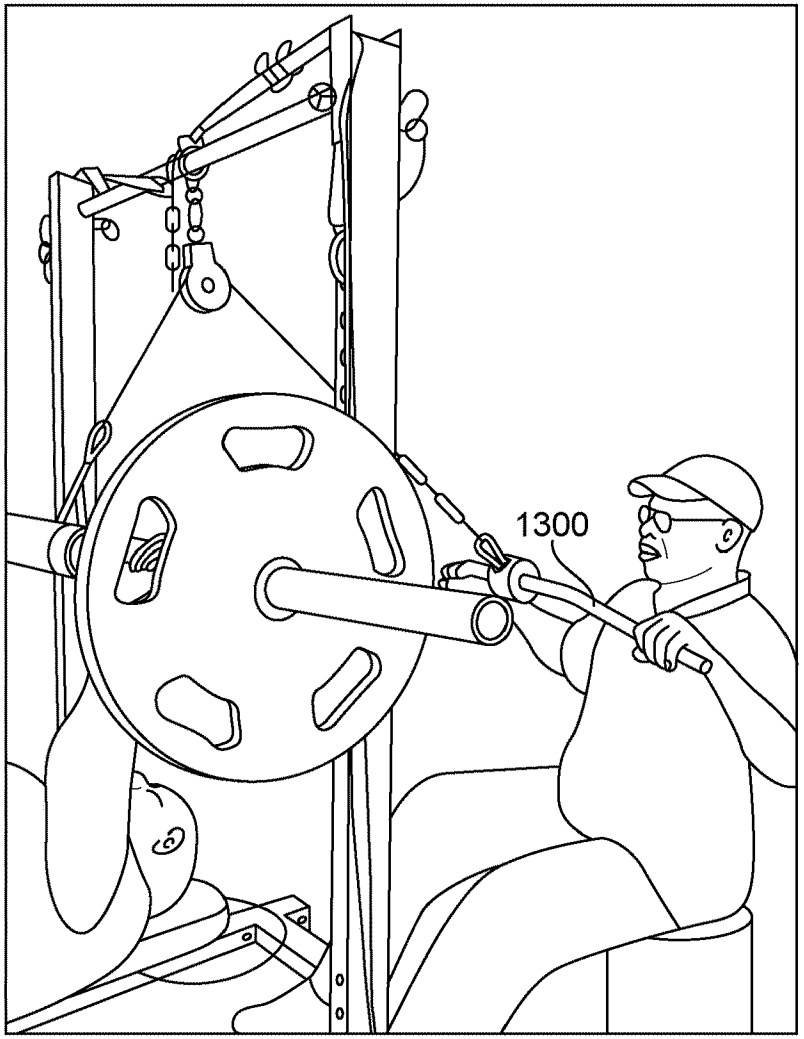
FIGS. 13 and 14 show an example operation of the exercise assistance system where the spotter uses a handlebar from a sitting position (FIG. 13) and a standing position (FIG. 14) to operate the pulley to raise (FIG. 13) and lower (FIG. 14) the bar.
Figure 13:
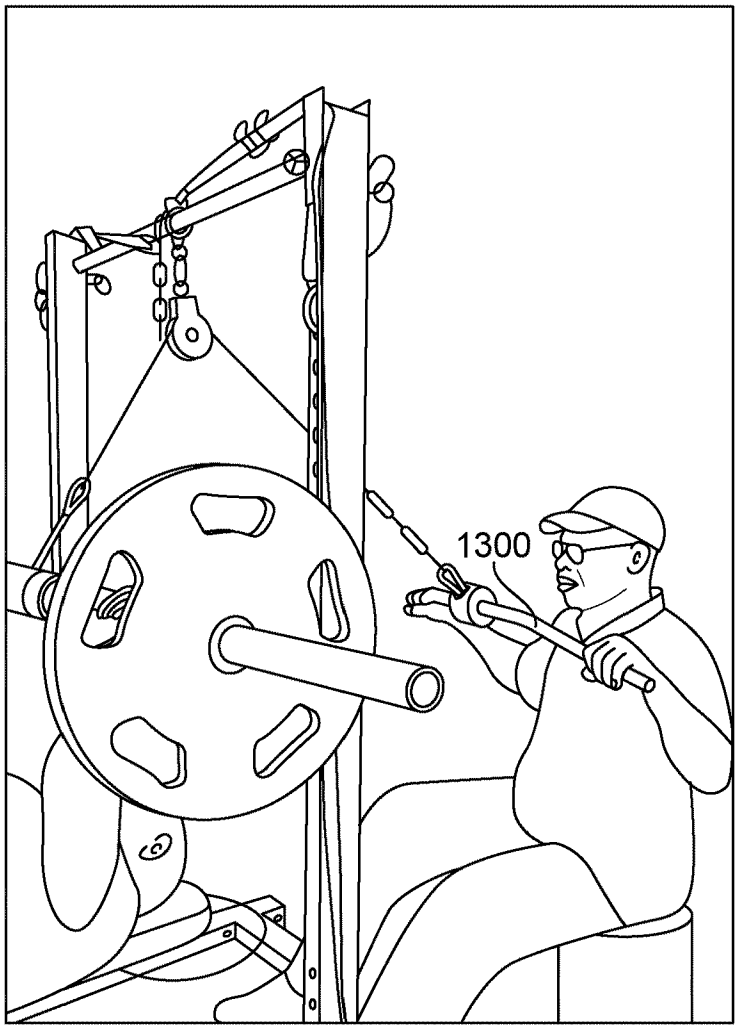
Figure 14:
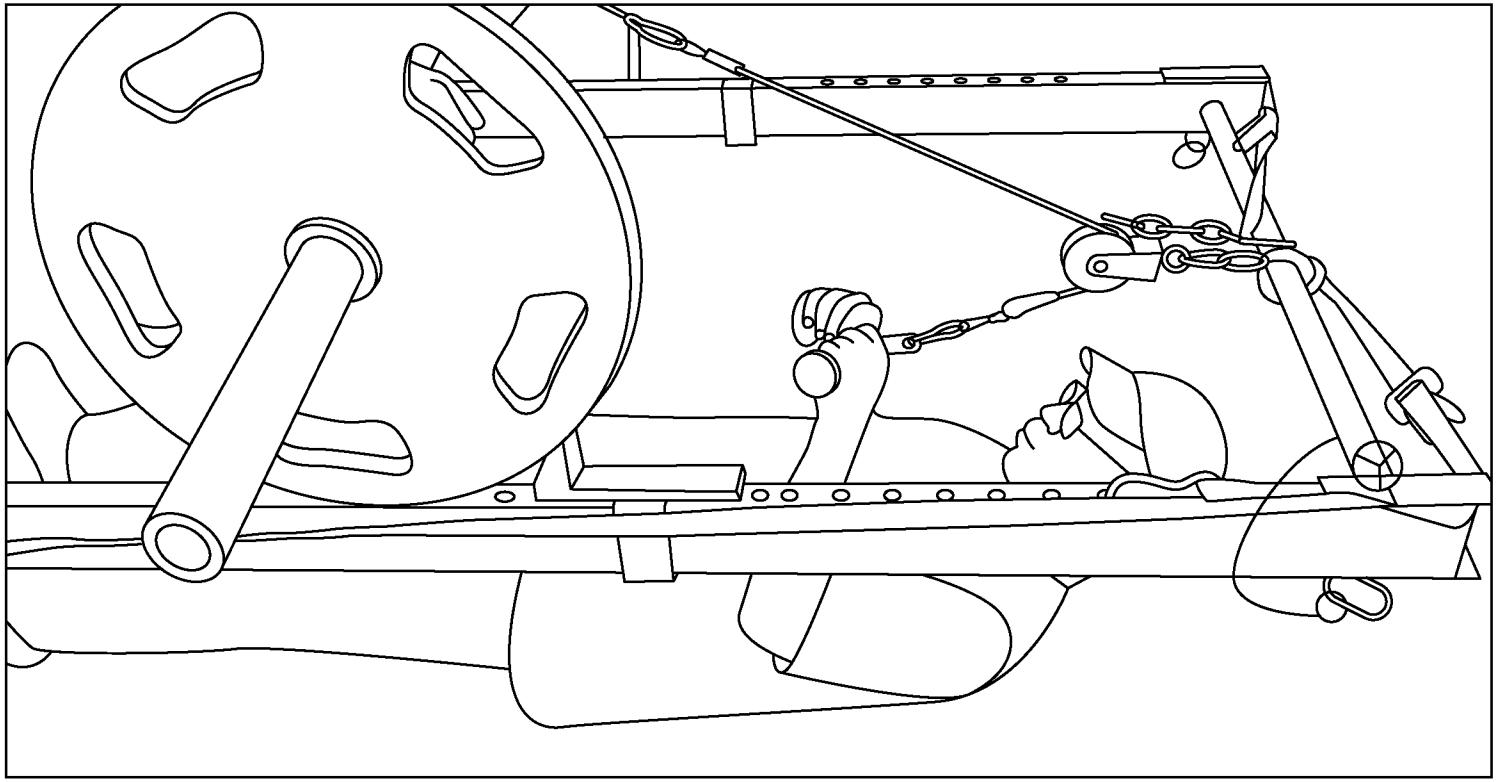

FIG. 12 shows another example operation of the exercise assistance system where a spotter positioned behind a lifter in a standing position pulls (left) or releases (right) a loop vertically to operate the pulley to lower (left) and raise (right) the bar. FIGS. 13 and 14 show an example operation of the exercise assistance system where the spotter, positioned behind the lifter and moving between a sitting position (FIG. 13) and a standing position (FIG. 14), manipulates (e.g. pulls and releases) a handlebar between to operate the pulley to raise (FIG. 13) and lower (FIG. 14) the bar.

Figure 15:
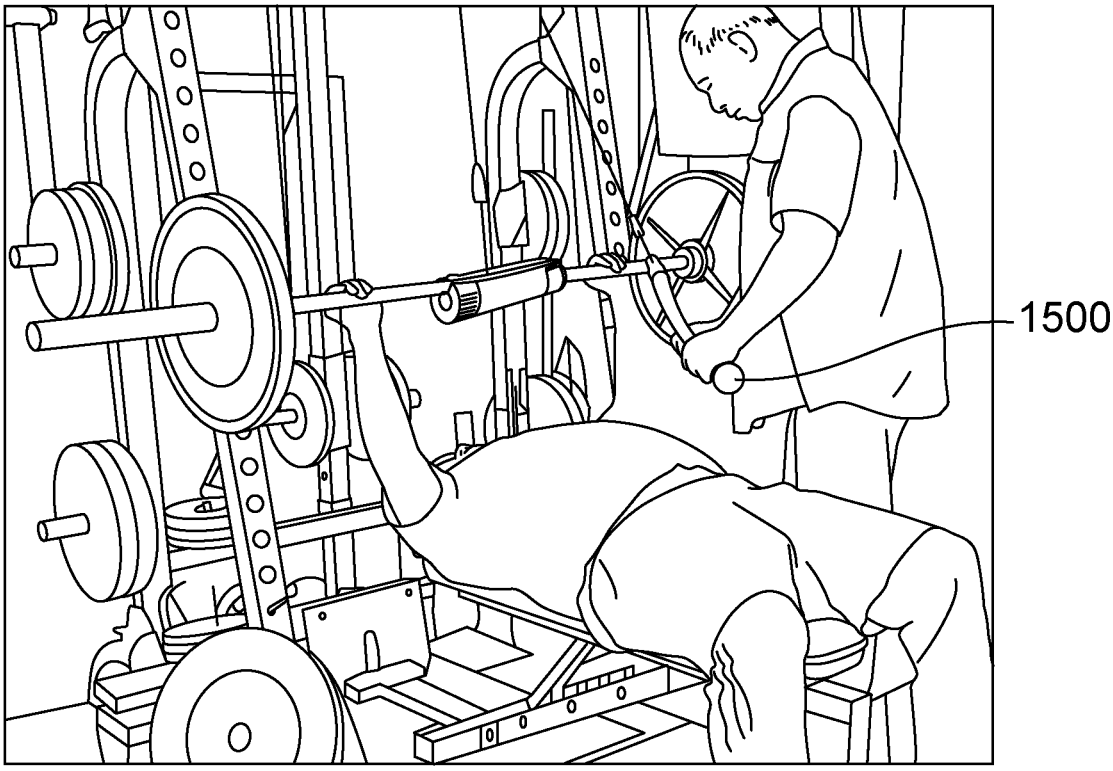
FIG. 15 shows another example operation of the exercise assistance system where the spotter manipulates an end of a rope providing the pulley cable to operate the pulley to raise (left) and lower (right) the bar.
Figure 15:
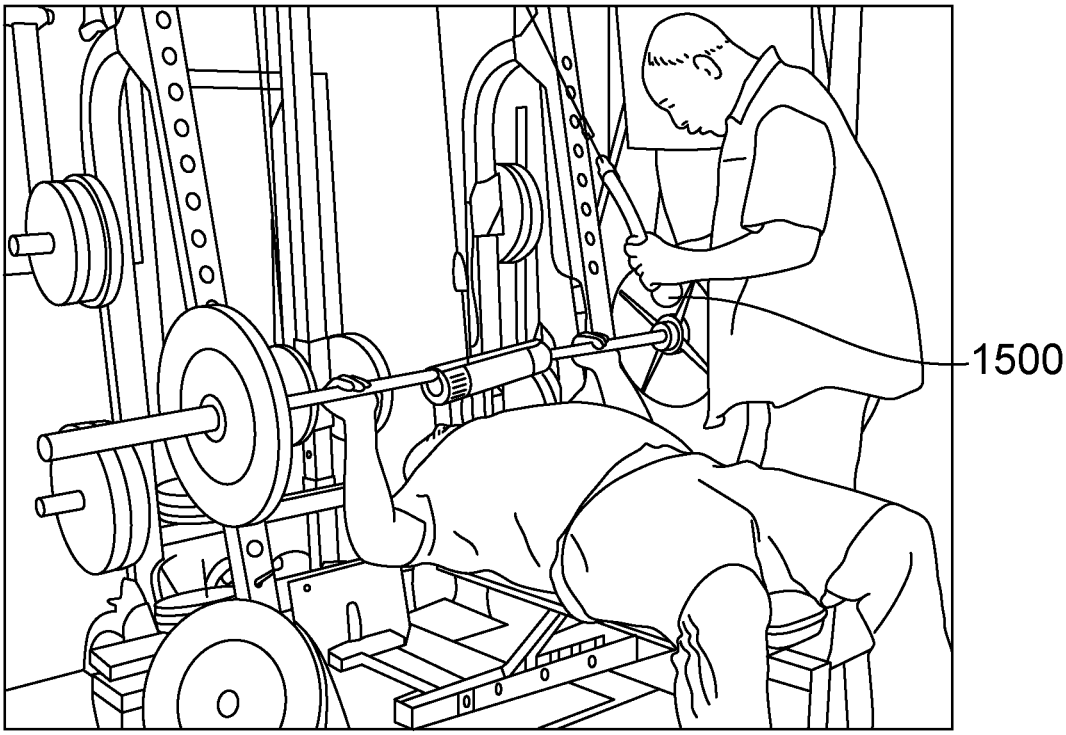

FIG. 15 shows another example operation of the exercise assistance system where the spotter is positioned in front of the lifter in a standing position. The spotter manipulates an end of a rope providing the pulley cable to manipulate (e.g., pull, release) the pulley to raise (left) and lower (right) the bar.

Figure 16:
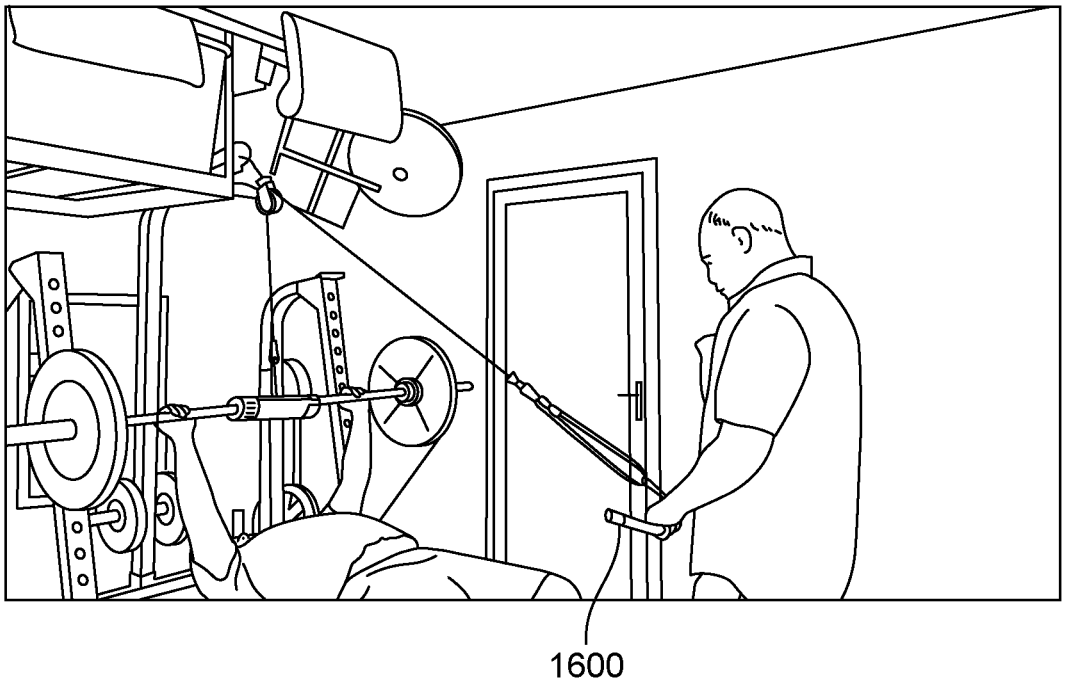
FIG. 16 shows another example operation of the exercise assistance system where the spotter using a handlebar from a standing position (top) and a sitting position (bottom) to operate the pulley to raise and lower the bar.
Figure 16:
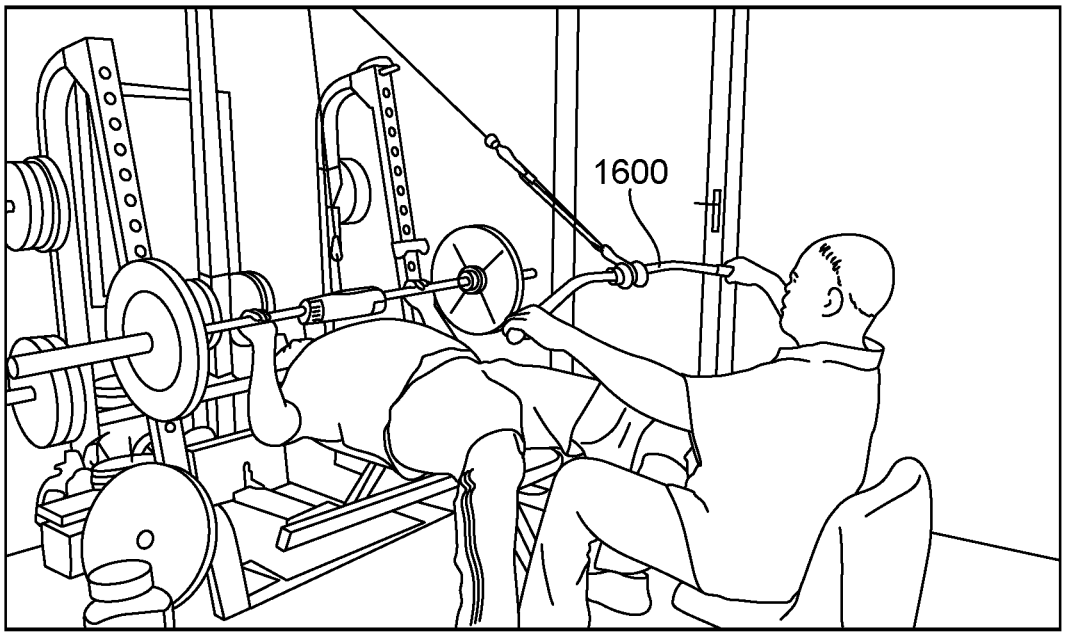

FIG. 16 shows another example operation of the exercise assistance system where the spotter is positioned in front of the lifter. The spotter moves between a standing position (top) and a sitting position (bottom) to manipulate (e.g., pull, release) a handlebar to operate the pulley to raise (top) and lower (bottom) the bar.

Figure 17:
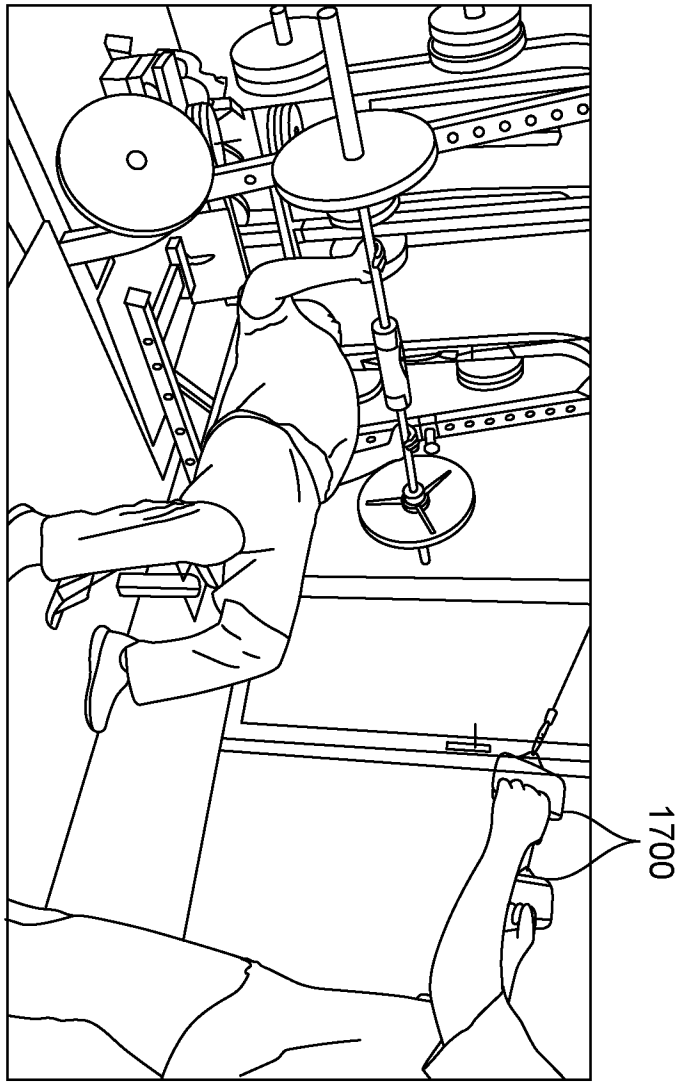
FIG. 17 shows another an example operation of the exercise assistance system where the spotter manipulates a pair of handles or loops connected to the pulley cable to operate the pulley to raise and lower the bar.

FIG. 17 shows another an example operation of the exercise assistance system where the spotter is positioned in front of the lifter in a standing position. The spotter manipulates (e.g., pulls, releases, extends, separates, etc.) a pair of handles or loops connected to the pulley cable to operate the pulley to raise and lower the bar.

Any of the above aspects and embodiments can be combined with any other aspect or embodiment as disclosed here in the Summary, Figures and/or Detailed Description sections.

As used in this specification and the claims, the singular forms "a," "an" and "the" include plural referents unless the context clearly dictates otherwise.

Unless specifically stated or obvious from context, as used herein, the term "or" is understood to be inclusive and covers both "or" and "and".

Unless specifically stated or obvious from context, as used herein, the term "about" is understood as within a range of normal tolerance in the art, for example within 2 standard deviations of the mean. About can be understood as within 20%, 19%, 18%, 17%, 16%, 15%, 14%, 13%, 12% 11%, 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Unless specifically stated or obvious from context, as used herein, the terms "substantially all", "substantially most of", "substantially all of" or "majority of" encompass at least about 90%, 95%, 97%, 98%, 99% or 99.5%, or more of a referenced amount of a composition.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents. Incorporation by reference of these documents, standing alone, should not be construed as an assertion or admission that any portion of the contents of any document is considered to be essential material for satisfying any national or regional statutory disclosure requirement for patent applications. Notwithstanding, the right is reserved for relying upon any of such documents, where appropriate, for providing material deemed essential to the claimed subject matter by an examining authority or court.

Modifications may be made to the foregoing without departing from the basic aspects of the invention. Although the invention has been described in substantial detail with reference to one or more specific embodiments, those of ordinary skill in the art will recognize that changes may be made to the embodiments specifically disclosed in this application, and yet these modifications and improvements are within the scope and spirit of the invention. The invention illustratively described herein suitably may be practiced in the absence of any element(s) not specifically disclosed herein. Thus, for example, in each instance herein any of the terms "comprising", "consisting essentially of", and "consisting of" may be replaced with either of the other two terms. Thus, the terms and expressions which have been employed are used as terms of description and not of limitation, equivalents of the features shown and described, or portions thereof, are not excluded, and it is recognized that various modifications are possible within the scope of the invention. Embodiments of the invention are set forth in the following claims.

A number of embodiments of the invention have been described. Nevertheless, it can be understood that various modifications may be made without departing from the spirit and scope of the invention. Accordingly, other embodiments are within the scope of the following claims.

What is claimed is:

1. An apparatus for enabling a spotter to assist a lifter in a weight lifting exercise, the apparatus comprising:

a clamp for removably attaching to and enclosing a bar for free weights in an interior therein, the clamp securely retaining the bar along a length of the clamp, the bar being lifted by the lifter during the weight lifting exercise; the clamp being securely and removably attachable to a cable at an attachment end of the cable, the cable being disposed about a wheel of a pulley that is anchored to a stable point;

wherein a free end of the cable is manipulable by the spotter to selectively operate the pulley to assist with raising and lowering the bar.

2. The apparatus of claim 1, wherein the stable point comprises a portion of a frame of a weight rack.

3. The apparatus of claim 1, wherein the clamp comprises:

first and second semi-cylindrical sections removably coupled to one another to together define the interior of the clamp; and/or at least one clamp lock removably coupled to the first and second sections to secure a connection.

4. The apparatus of claim 1, wherein the first and second sections are further coupled to one another via one or more hinges.

5. The apparatus of claim 1, further comprising:

an insert disposed within the interior of the clamp, the insert comprising first and second sections for being removably disposed about the bar to accommodate the bar in an interior of the insert;

wherein the insert accommodates bars of varying diameters.

6. The apparatus of claim 1, further comprising: an additional clamp for anchoring the pulley to the stable point, the additional clamp being securely and removably attachable to the pulley and removably attachable to the stable point.

7. The apparatus of claim 1, wherein the clamp is a double-length clamp, and the additional clamp is a single-length clamp.

8. The apparatus of claim 1, further comprising: a cylindrical wrap of a soft material disposed around an outer surface of the clamp.

9. The apparatus of claim 1, wherein the free end of the cable includes a manipulable member for to selectively operate the pulley, the manipulable member comprising one or more of loops, handles, handlebars, or grips.

10. The apparatus of claim 1, wherein the cable comprises one or more of a cable, cord, line, or rope.

11. The apparatus of claim 1, wherein the free end of the cable is disposed behind a bench for the lifter and/or in front of a weight rack.

12. The apparatus of claim 1, wherein the free end of the cable is disposed in front of a bench for the lifter and/or in front of a weight rack.

* * * * *